US008601714B2

(12) United States Patent
Morrison et al.

(10) Patent No.: US 8,601,714 B2
(45) Date of Patent: Dec. 10, 2013

(54) GRAIN TURNER FOR TOWER GRAIN DRYER AND METHOD OF DRYING

(75) Inventors: David Morrison, Carlinville, IL (US); Jared Becker, Taylorville, IL (US)

(73) Assignee: The GSI Group, LLC, Assumption, IL (US)

( * ) Notice: Subject to any disclaimer, the term of this patent is extended or adjusted under 35 U.S.C. 154(b) by 358 days.

(21) Appl. No.: 13/180,140

(22) Filed: Jul. 11, 2011

(65) Prior Publication Data

US 2012/0011736 A1 Jan. 19, 2012

Related U.S. Application Data

(60) Provisional application No. 61/364,163, filed on Jul. 14, 2010.

(51) Int. Cl.
*F26B 11/02* (2006.01)

(52) U.S. Cl.
USPC ..... 34/167; 34/174; 209/390; 56/209; 241/101.2; 460/73; 366/287

(58) Field of Classification Search
USPC ..... 34/64, 165, 167, 169, 174; 209/29, 283, 209/386, 390, 616; 56/16.6, 13.4, 209, 56/DIG. 1; 241/101.2; 460/13, 68, 73, 111; 366/261, 282
See application file for complete search history.

(56) References Cited

U.S. PATENT DOCUMENTS 3,238,637 A * 3/1966 Mark et al. ..... 34/65
3,538,618 A * 11/1970 Neuenschwander ..... 34/102
3,751,824 A 8/1973 Kyle
3,849,901 A * 11/1974 Sietmann et al. ..... 34/526
4,149,844 A 4/1979 Noyes
4,162,857 A * 7/1979 Spurling ..... 366/261
4,250,632 A 2/1981 Botkins et al.
4,308,669 A 1/1982 Noyes et al.
4,404,756 A * 9/1983 Noyes ..... 34/65

(Continued)

FOREIGN PATENT DOCUMENTS

DE 4143345 A1 * 6/1993 ..... B65H 54/80
EP 327650 A1 * 8/1989 ..... F26B 11/04

(Continued)

*Primary Examiner* — Steve M Gravini
(74) *Attorney, Agent, or Firm* — Polster Lieder Woodruff & Lucchesi, L.C.

(57) ABSTRACT

A grain turner for turning grain in a drying tower includes opposed generally vertical side walls and a generally vertical dividing plate (which is shorter than the side walls) extending between the side walls; the dividing plate defining inner and an outer vertical channels in a portion of the turner. An inner inclined plate is pivotally connected to one side wall to be within the inner channel and an outer inclined plate is connected to the other side wall to be within the outer channel. The inclined plates are pivotal between a first position in which they are inclined downwardly in a opposite widthwise directions and a second position in which they are generally adjacent their respective side walls. The inclined plates have a length such that when they are in the first position, their lower edges are proximate a bottom of the divider plate. Further, the inner and outer inclined plates each define a curve such that when the inclined plates are in the raised position, the inner inclined plate directs grain from the inner channel to the space below outer channel and the outer inclined plate directs grain from the outer channel to the space below the inner channel.

19 Claims, 12 Drawing Sheets

(56) References Cited

U.S. PATENT DOCUMENTS

| | | | | | |
|---|---|---|---|---|---|
| 5,045,182 | A | * | 9/1991 | Butler | 209/240 |
| 5,566,470 | A | | 10/1996 | Morrison | |
| 5,651,193 | A | | 7/1997 | Rhodes et al. | |
| 5,758,778 | A | * | 6/1998 | Kershner | 209/29 |
| 5,860,221 | A | * | 1/1999 | Morrison et al. | 34/64 |
| 6,035,544 | A | * | 3/2000 | Morrison et al. | 34/167 |
| 6,073,364 | A | | 6/2000 | McKenzie et al. | |
| 6,073,367 | A | | 6/2000 | McKenzie et al. | |
| 6,076,276 | A | | 6/2000 | McKenzie et al. | |
| 6,233,843 | B1 | | 5/2001 | McKenzie et al. | |
| 7,908,835 | B2 | * | 3/2011 | Bertino | 56/122 |
| 2009/0000144 | A1 | * | 1/2009 | Berg | 34/218 |
| 2012/0011736 | A1 | * | 1/2012 | Morrison et al. | 34/165 |

FOREIGN PATENT DOCUMENTS

| | | | | | |
|---|---|---|---|---|---|
| JP | 01217184 | A | * | 8/1989 | F26B 25/22 |
| JP | 09280735 | A | * | 10/1997 | F26B 17/14 |
| JP | 2008169737 | A | * | 7/2008 | |
| WO | WO 2010132037 | A1 | * | 11/2010 | B07B 1/26 |

* cited by examiner

GRAIN TURNER FOR TOWER GRAIN DRYER AND METHOD OF DRYING

CROSS-REFERENCE TO RELATED APPLICATIONS

This Non-Provisional application claims priority to U.S. Provisional Application Ser. No. 61/364,163 filed Jul. 14, 2010, which is incorporated herein by reference.

STATEMENT REGARDING FEDERALLY SPONSORED RESEARCH

Not applicable.

BACKGROUND OF THE INVENTION

This disclosure relates to a grain turner for a tower grain dryer or the like; and in particular, to such a grain turner that is movable between a collapsed position which allows grain to flow vertically within a grain column of the dryer and an extended position which the grain turner turns the grain from the inside to the outside of the grain column and vice versa as the grain moves downwardly within the grain column.

Generally, tower grain dryers comprise a vertical tower of cylindrical or other shape. The tower has a plenum located within the tower. A burner is located within the tower dryer and one or more blowers force air heated by the burners into the plenum. The outer cylindrical wall of the plenum is perforated; and an outer, perforated cylindrical wall surrounds the plenum wall, where the outer wall and the plenum wall define a grain drying column therebetween. Typically, heated air from within the plenum is forced through the perforated plenum wall and into the grain column, and air and moisture from the grain column is exhausted to the atmosphere. In this manner, the grain in the grain column is heated and dried as the grain moves down in the grain column. As is typical in tower dryers, cool, ambient air is drawn toward the blower and the burner through the grain column so as to cool the dried grain and to recover heat from the grain.

During operation, wet grain to be dried is conveyed to the upper reaches of the tower and is evenly distributed around the grain path. As dried grain is continuously discharged from the lower end of the grain drying path, additional grain to be dried is loaded into the upper end of the drying path such that the tower dryer is a continuous flow grain dryer.

Conventionally, many of the tower grain dryers and continuous flow portable dryers now in use are so-called cross flow, column dryers. That is, as the vertical grain in the grain column is metered downwardly as controlled by metering the flow of dried grain from the bottom of the grain column, heated air is forced outwardly from the plenum through the grain path. Thus, the grain proximate the inner wall of the grain path is heated more than the grain proximately the outer wall of the dryer. The grain along the inner wall becomes over dried and the grain on the exterior of the grain path is under dried. In order to overcome this problem of uneven drying, such tower dryers are often provided with a variety of grain turning devices within the grain column that turn the grain from the inner wall to the outer wall and vice versa so as to more evenly dry the grain in the grain column. More than one of these grain turners has been used.

Grain turners (sometimes referred to as inverters) play an important role in the grain drying process of a cross flow dryer. As grain is dried, a "drying front" moves through the grain column toward the exterior of the dryer. This creates a moisture gradient from the inside (dry grain) to the outside (moist grain) of the grain mass in the column. Turners are placed in the grain column to move or mix the grain so that the resulting product is more evenly dried. A grain turner is shown in U.S. Pat. No. 6,035,544, which is incorporated by reference. This grain turner divides the grain path in a rotated 180° configuration (i.e., substantially twisted about a vertical axis) so that the grain on the outside of the grain path is exchanged with the grain on the inside of the grain path (and vice versa).

Situations exist, however, in which turners are not desired, such as when drying products such as wheat or soybeans. For these products, adequate drying is achieved by passing through the drying path. Similar to the grain, these products are conveyed to fall within the drying path. Current turners are fixed. Hence, if a farmer or grain store desires to not "turn" product in the drying path, they will have to use separate equipment. It would be desirable to provide a turner which will allow farmers, grain stores, etc. to use the same drying tower for product which must be turned, and for product which need not be turned.

BRIEF DESCRIPTION OF THE SEVERAL VIEWS OF THE DRAWINGS

In the accompanying drawings which form part of the specification.

Corresponding reference characters represent corresponding parts throughout the various views of the drawings.

DETAILED DESCRIPTION OF A PREFERRED EMBODIMENT

The following detailed description illustrates the claimed invention by way of example and not by way of limitation. The description clearly enables one skilled in the art to make and use the disclosed invention, describes several embodiments, adaptations, variations, alternatives, and uses of the disclosed invention, including what is presently believed to be the best mode of carrying out the disclosed invention.

The present disclosure relates to a grain turner for a grain dryer, such as a tower dryer or a modular (portable) dryer. The grain turner of this disclosure is configured to move between a collapsed position (as shown in FIGS. 12-21), which allows product to move by gravity within a vertical path (vertical grain column) of the grain dryer and an extended (or operative or "up") position (as shown in FIGS. 2-11) in which the grain is turned from the inside to the outside of the grain column and vice versa as the grain moves downwardly within the grain column through the grain turner. The turner can be used for any material flow path as desired. However, for purposes of illustration only, the turner will be described for use with a grain dryer.

Components of the turner can have a variety of cross sectional shapes such as, but not limited to, elliptical, oval, circular, triangular, square, rectangular, tubular or other appropriate geometric configuration. Components of the turner can be made of a variety of materials, such as, but not limited to, steel, cast iron, aluminum or plastic. The turner can be of any size to accommodate characterizations of users of any size and to accommodate characterizations of dryers of varying cross-sectional shapes and sizes.

Figure 1:
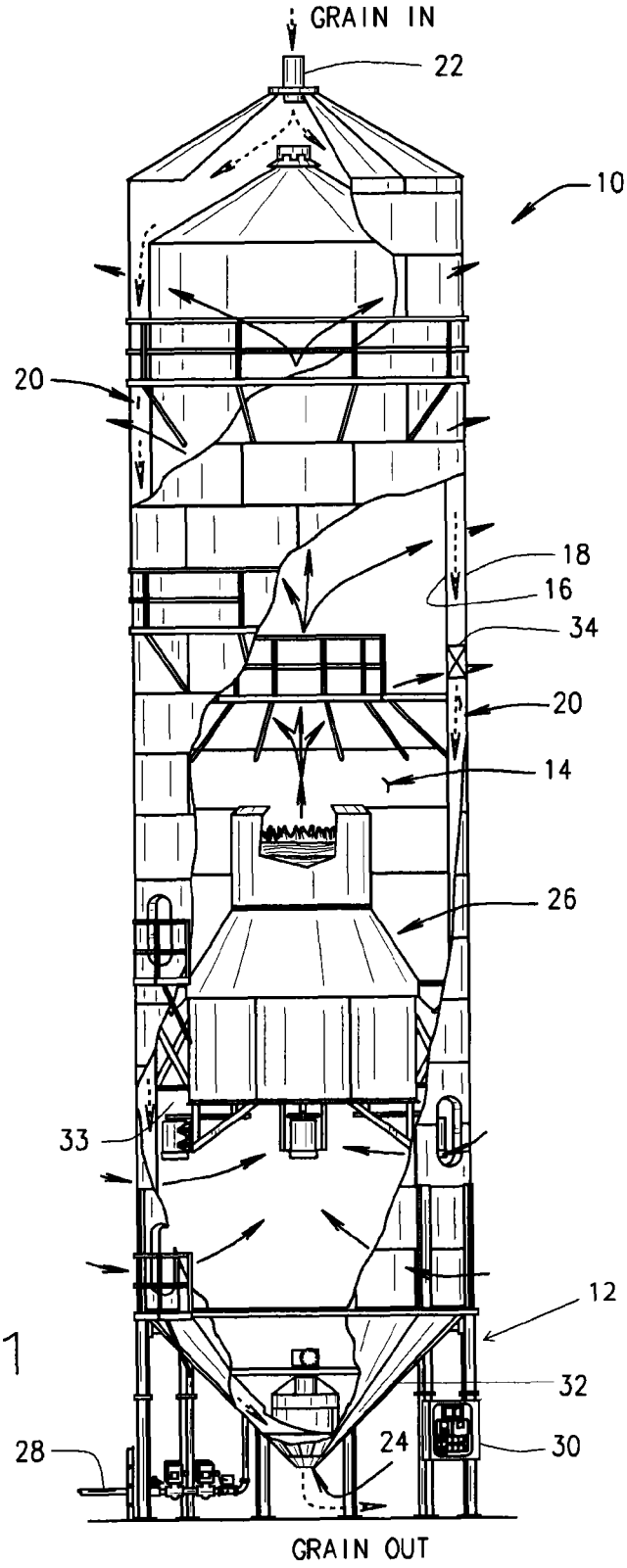
FIG. 1 is an elevational view (with portions broken away) of a tower grain dryer having a grain turner, the grain turner being shown installed in the dryer path of the dryer.
Figure 2:
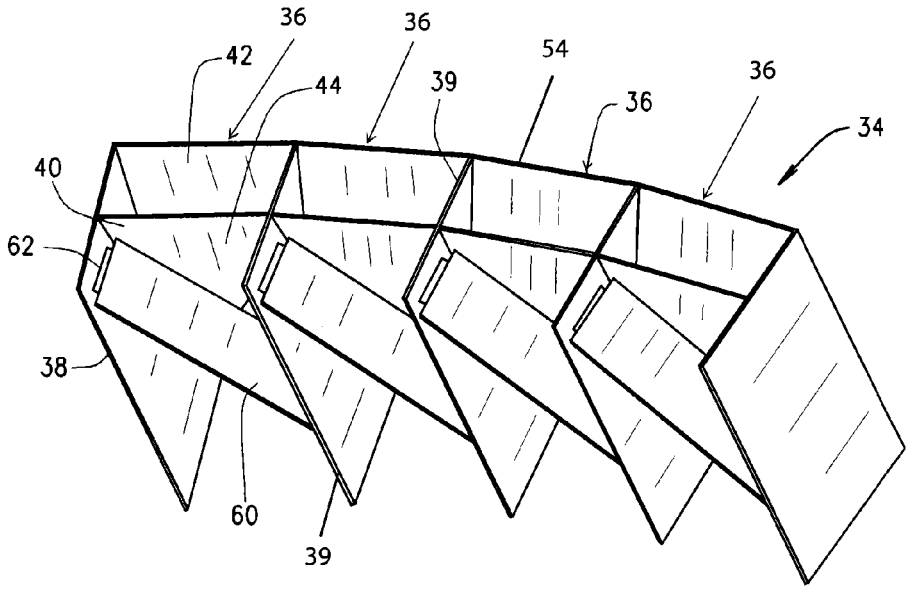
FIG. 2 is a top perspective view of a section of the grain turner illustrating four turning modules arranged in side-by-side relation and further arranged in an extended or "up" position so as to be readily installed within the grain path of the grain dryer.
Figure 3:
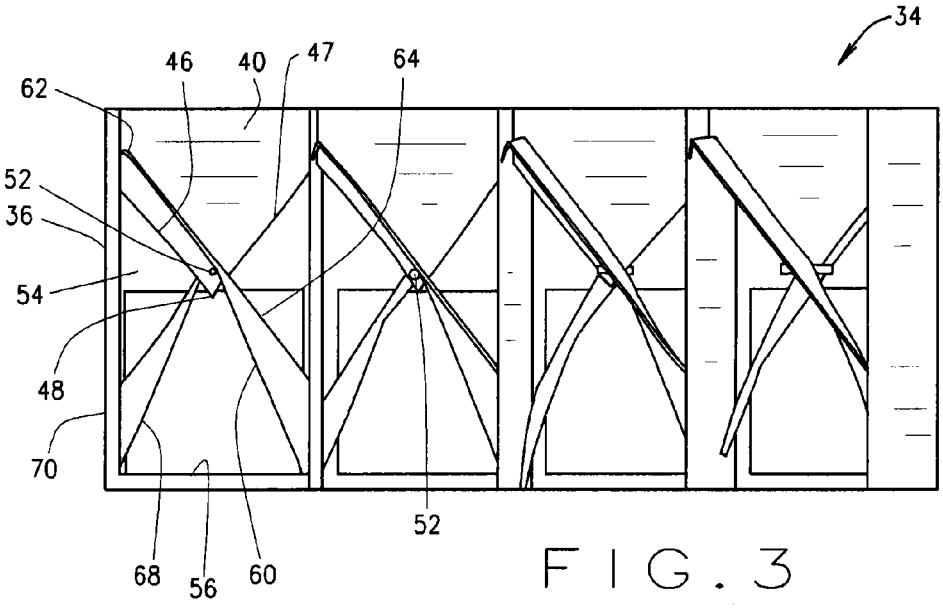
FIG. 3 is a front elevational view of the grain turner modules of FIG. 2 illustrating for each module: side walls, an outer wall, an access opening, a vertical plate, plates pivotally connected to the side walls and a pin supporting the plates in the "up" position.
Figure 4:
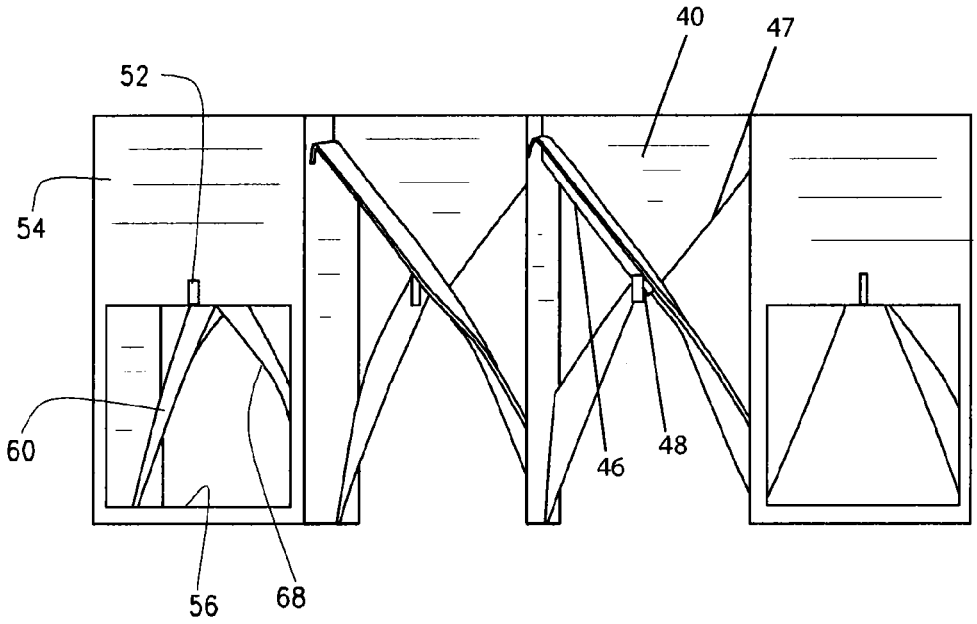
FIG. 4 is a back elevational view of the grain turner modules of FIGS. 2 and 3 with the outer walls of the two middle grain turner modules removed so as to better illustrate the shape and function of the various components of the turner modules, with FIG. 4 further illustrating a handle or pin.
Figure 5:
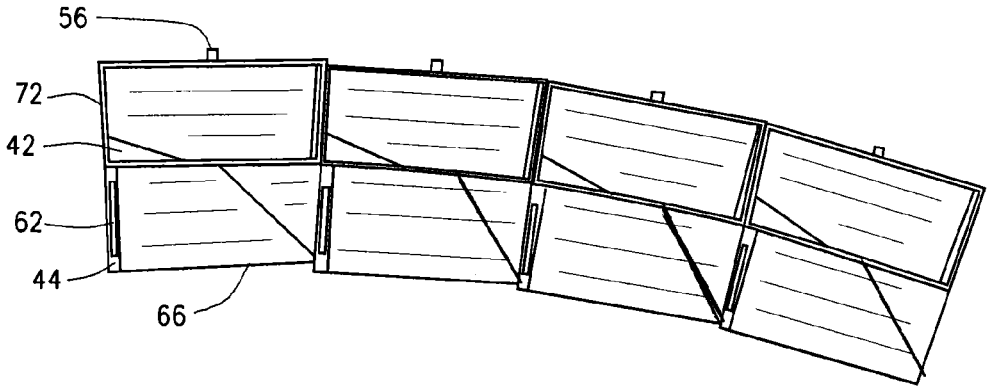
FIG. 5 is a top view of the turner modules of FIG. 2.
Figure 6:
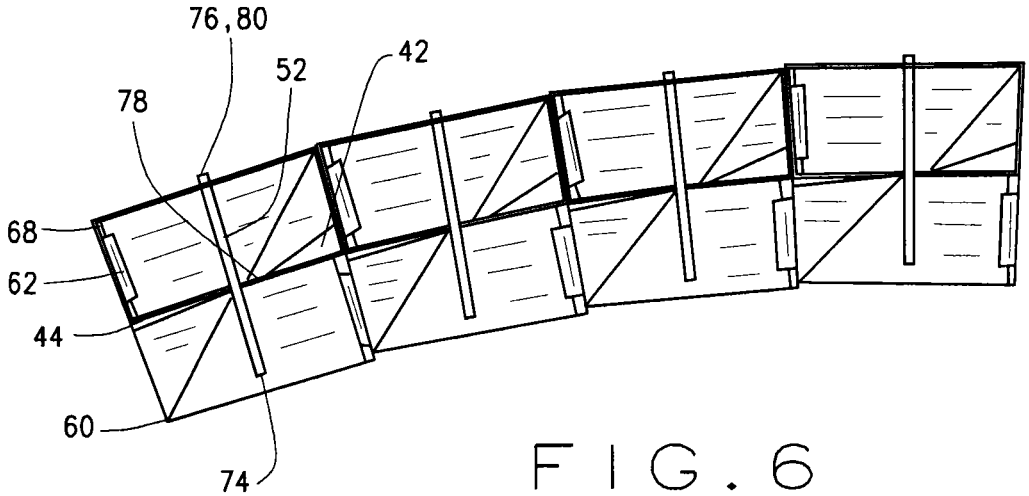
FIG. 6 is a bottom view of the turner modules of FIG. 2.
Figure 7:
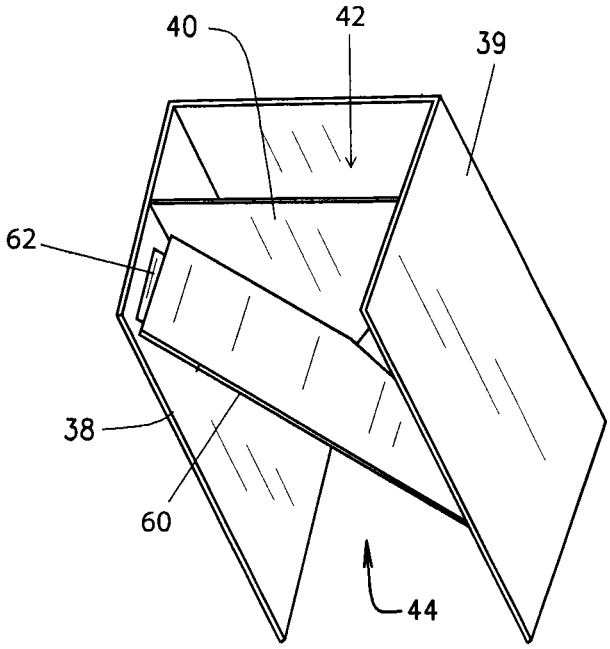
FIG. 7 is a perspective view of a single module of the grain turner, with FIG. 7 illustrating the plates in the "up" position supported by the pin.
Figure 8:
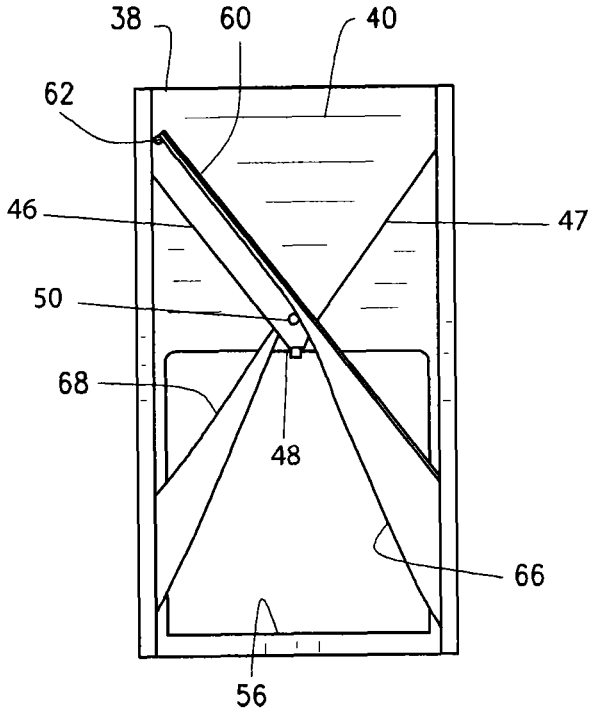
FIG. 8 is front elevational view of the module of FIG. 7.
Figure 9:
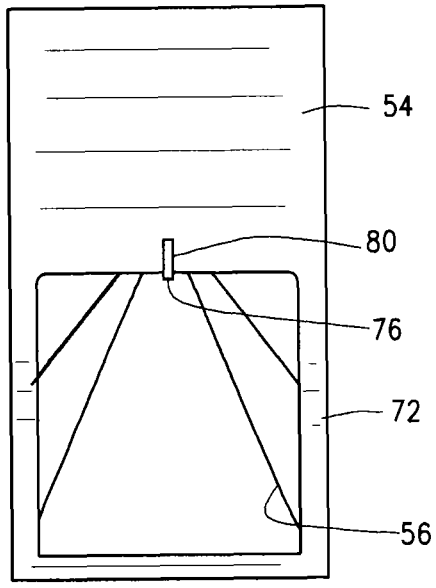
FIG. 9 is a back elevational of the module of FIG. 7.

Referring now to the drawings, and more particularly to FIG. 1, a cylindrical tower dryer 10 is shown in partial cross section. More specifically, the tower dryer comprises a vertical grain drying tower 10 which may, for example, be fifty (50) feet (15+m.) or more in height. The tower 10 has a base 12 of suitable structural steel members mounted in a suitable foundation (not shown). A plenum 14 is disposed within the tower dryer 10. The plenum 14 is defined by a generally cylindrical porous (perforate) plenum wall 16, which wall is also referred to as an inner wall. The tower 10 has an outer cylindrical dryer wall 18 of porous construction surrounding plenum wall 16 and spaced outwardly therefrom so as to define a vertical, annular grain drying path 20 (sometimes referred to as a grain column). Grain may be supplied to grain drying path 20 by means of a grain inlet 22 at the top of tower 10 and dried grain may be discharged from the tower dryer by means of a grain discharge outlet 24 at the lower end of the dryer.

As generally indicated at 26, a heater/blower assembly is provided within the grain dryer for drawing ambient air through the grain path 20 in the lower reaches of the tower 10 and, if demanded, for heating the air, and for forcing the heated air under pressure into plenum 14. In this manner, the air discharged from heater/blower 26 is distributed substantially uniformly within the plenum and is forced to flow through the porous plenum wall 16, through the grain in grain drying path or grain column 20, and is exhausted through the porous outer wall 18 to the atmosphere thereby drying the grain in the grain drying path 20 and carrying moisture from the grain to the atmosphere. While the heater/blower 26 is shown in FIG. 1 to be located within tower 10, it will be understood that the heater blower 26 may be located outside the tower in close proximity thereto and air from the heater blower 26 may be ducted into plenum 14. Typically, fuel for heater blower 26 is supplied by gas fuel supply lines 28 and operation of the heater blower 26 and overall operation of tower dryer 10 is typically controlled by a computer control housed in a control panel 30.

As shown in FIG. 1, tower 10 has a converging conical hopper bottom 32. The grain path 20 may be divided into a plurality of vertical grain channels by vertically extending pairs of channel members having one flange secured to the inner wall 16 and another flange secured to outer dryer wall 18. For example, depending on the diameter of the tower dryer 10, the grain path 20 may be divided into about 12-20 of such grain channels. In other embodiments of tower dryers, such as disclosed in U.S. Pat. Nos. 6,073,364; 6,073,367; 6,076,276 and 6,233,843 (all of which are incorporated herein by reference), the conical hopper is replaced with a flat, horizontal discharge floor and the grain is discharged onto this floor and is swept to a central discharge opening by means of rotary sweeps.

In tower dryers, a divider 33 is placed within the tower so as to divide the grain column 20 between an upper heated zone and a lower cooling zone. Air from within the plenum 14 is discharged through the inner tower wall 16, through the grain column and through the outer tower wall 18 thereby to heat and to dry the grain. Ambient air is drawn through the outer tower wall 18, the grain in the grain column 20 and through the inner tower wall 16 as it flows to the blowers thereby to cool the grain and to recover heat from the grain thereby increasing the efficiency of the dryer.

A grain turner 34 is positioned at one or more locations along the vertical drying column or path 20 of the tower 10 for turning (or inverting) some or all of the grain in the grain path 20. The turner 34 turns the grain (or inverts the grain column) such that the grain on the inner reaches of the grain path 20 is exchanged with grain from the outer reaches of the grain path 20. As will become apparent below, as the turner 34 turns the grain, the grain within a module of the turner is exchanged widthwise in the path 20 and within a turner module so that grain in a turner module is twisted approximately 180° about a vertical axis so as to intermix dry grain from the inner portion of the path 20 with less dry grain from the outer regions of the grain path 20. In this manner, dried grain proximate the inner wall 16 is moved outwardly and cooler, wetter or moister grain from the outer regions of the grain path 20 is moved closer to the inner wall. This configuration insures that grain is uniformly heated to a desired drying temperature so as to remove a desired amount of moisture from the grain without overheating the grain, which could damage the grain.

The grain turner 34 can be switched from its operative position (as shown in FIGS. 2-11) in which it turns and exchanges the grain flowing therethrough (as described above) to a collapsed position (as shown in FIGS. 12-21) within the grain path 20. In the collapsed position, the turner 34 does not turn the grain or other material flowing through the drying path, and allows the grain and other material, such as but not limited to, wheat or soybeans, to flow within the grain path 20 without being turned.

Referring now to FIGS. 2-21, the turner 34 of the present disclosure will be described in detail. The turner 34 is shown to be comprised of a plurality of turner modules 36. The height of the turner 34 may vary, depending on the size of the dryer in which it is installed. However, for a tower dryer 10 as shown in FIG. 1, the height of the turner modules 36 may be about 2 feet (61 cm). It will be appreciated that, depending on the diameter of the tower dryer, a multiplicity of such turner modules 36 may be needed so that the grain turner 34 will extend substantially continuously around the dryer at the location shown in FIG. 1. The section of the turner 34 illustrated in FIGS. 2-6 is shown to have four such turner modules 36 oriented in an extended, operative, or "up" position.

Referring to FIGS. 2-11, each module 36 comprises a pair of vertical side walls 38, 39, with each of the interior vertical side walls 38, 39 serving two adjacent modules 36 (i.e., the right side wall 38 of one module forms the left sidewall 39 of an adjacent module 36). Alternatively, each module 36 can include its own sidewalls 38, 39 wherein one sidewall 38 of a module 36 abuts another sidewall 39 of adjacent module 36. As shown in FIGS. 2-6, the side walls 38, 39 extend into the grain column from the inner wall 16 toward the outer wall 18 (FIG. 1) of the dryer. Between each of the side plates 38, 39, a vertical wall 40 is provided approximately midway between the inner and outer portions of the module 36 thus dividing the module 36 into an outer channel 42 and an inner channel 44. Each vertical plate 40 has downwardly sloped lower edges 46 and 47 (FIGS. 3-4 and 8) which are generally within the vertical plane of vertical plate 40. The lower edges 46, 47 converge at an apex 48 positioned opposite the top of the vertical plate 40.

Figure 13:
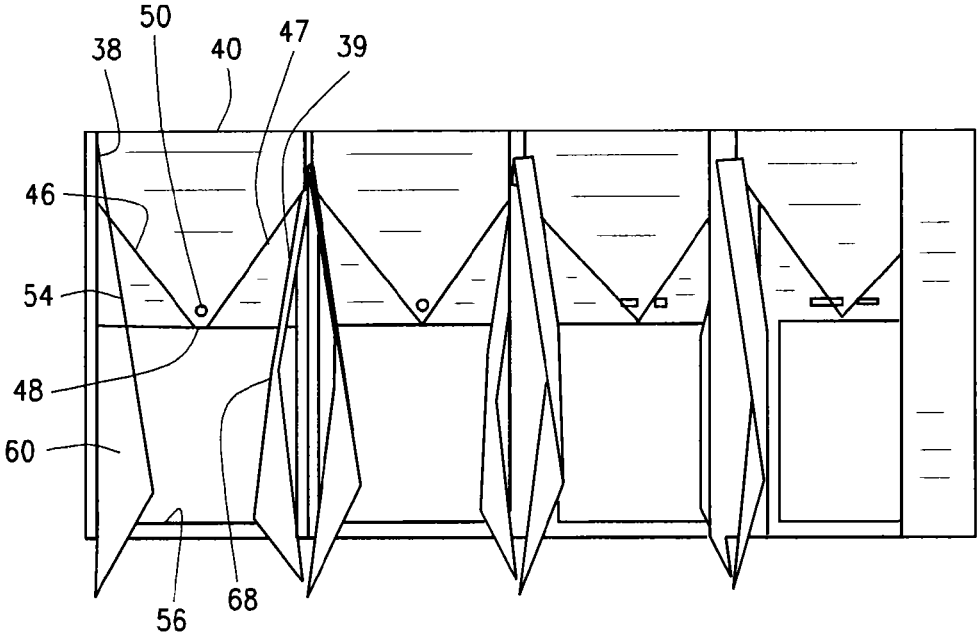
FIG. 13 is a front elevational view of the turner modules of FIG. 12.

The vertical plate 40 includes a pin aperture 50 extending there through. The pin aperture 50 is configured to accept a pin 52 of the turner 34 as will be discussed. The left most module 36 of FIG. 13 illustrates the pin 52 removed to show the pin aperture 50. As shown, the pin aperture 50 is positioned above the apex 48 of edges 46, 47.

Returning to FIG. 4, each of the modules 36 (or a group of such modules) may be provided with an outer vertical wall 54 which is spaced inwardly from outer dryer wall 18 (FIG. 1) a predetermined distance that corresponds generally to the thickness of a layer of grain to be by-passed around grain turner 34. For example, such vertical wall 54 may be spaced inwardly from dryer wall 18 a distance of about two inches (~5.1 cm). The outer vertical wall 54 preferably extends in heightwise direction approximately the full height of the turner 34. The wall 54 is spaced from vertical plate 40 to border the outer channel 42.

A portion of the outer wall 54, which is positioned below the apex 48 of the vertical wall 40, includes an access opening 56 extending there through. As illustrated, the opening 56 is square shaped. The opening 56, however, can have a variety of shapes such as, but not limited to, elliptical, oval, circular, triangular, square, rectangular, or other appropriate regular or irregular geometric configurations. The opening 56 is configured to enable the user to access the outer channel 44 and inner channel 42 of the turner, as will be discussed. Any opening 56 that provides user access is intended to be within the scope of the disclosure.

Figure 14:
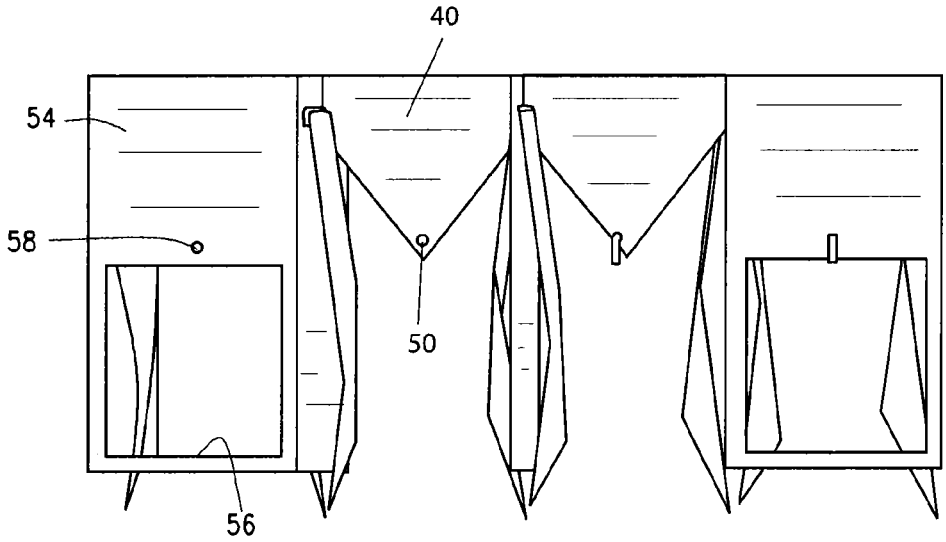
FIG. 14 is a back elevational view of the turner modules of FIG. 12, with the outer wall of the middle two turner modules removed so as to better illustrate the shape and function of the various components of the turner modules.
Figure 15:
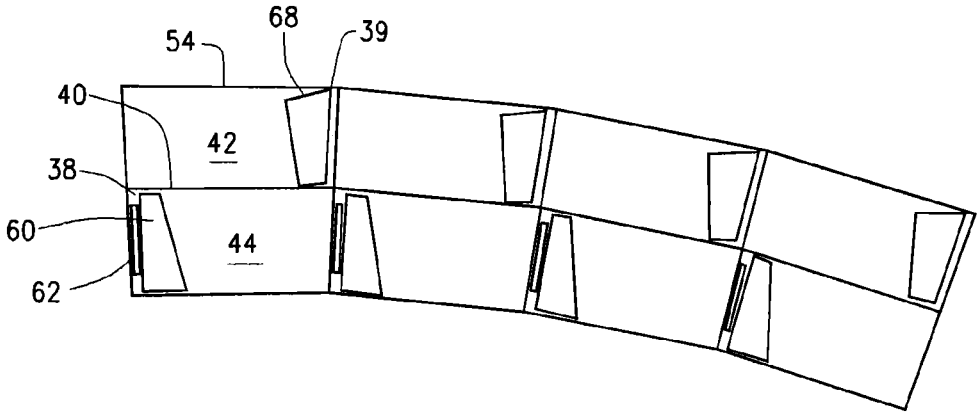
FIG. 15 is a top view of the turner modules of FIG. 12.
Figure 16:
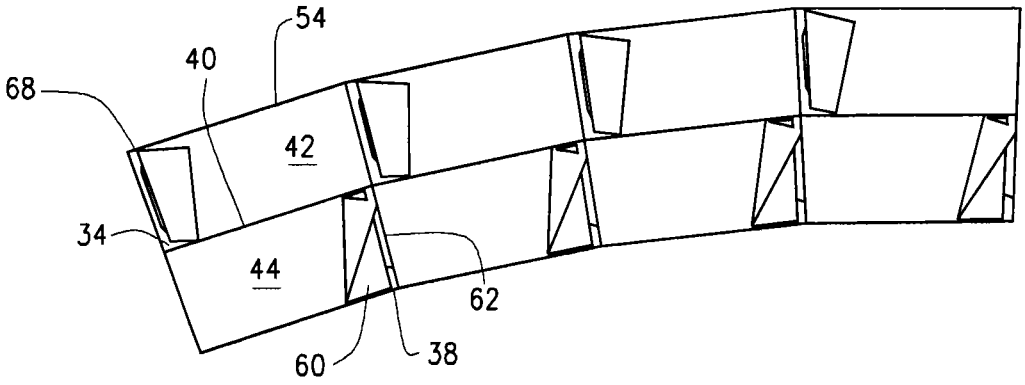
FIG. 16 is a bottom view of the turner modules of FIG. 12.
Figure 17:
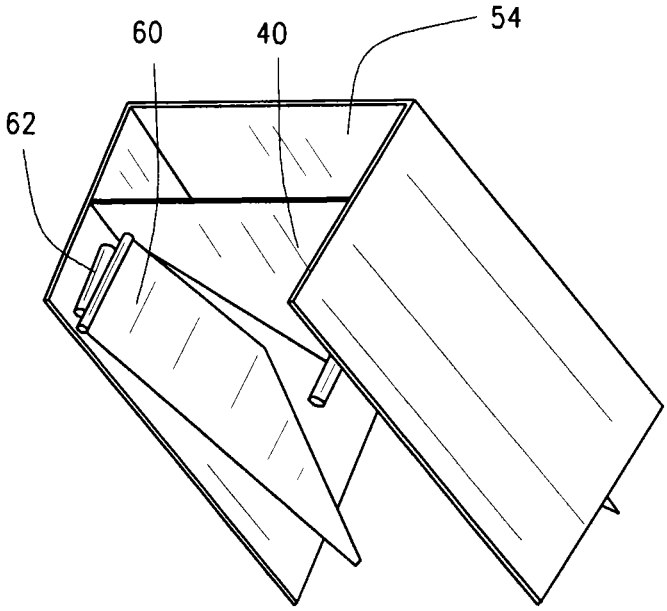
FIG. 17 is a perspective view of a single module of the grain turner, illustrating the plates in the "down" position.
Figure 18:
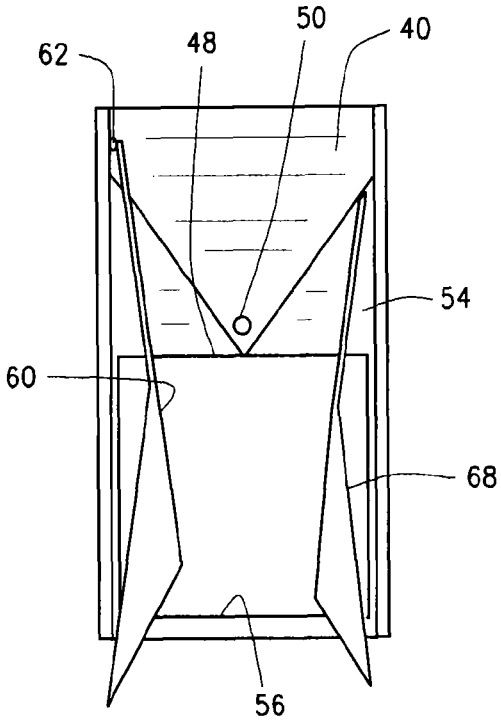
FIG. 18 is a front elevational view of the turner module of FIG. 17.
Figure 19:
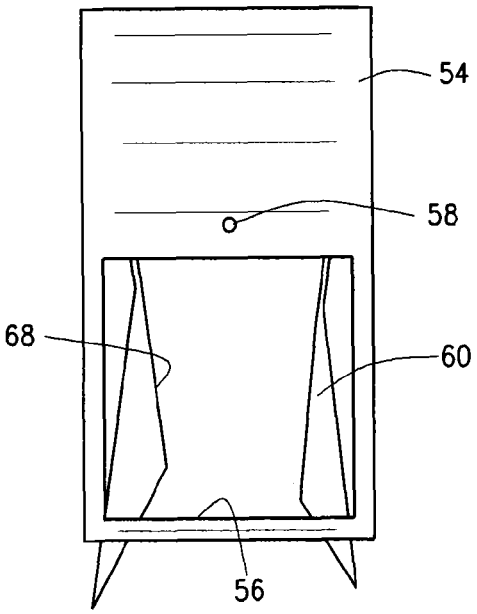
FIG. 19 is a back elevational view of the turner module of FIG. 17.
Figure 20:
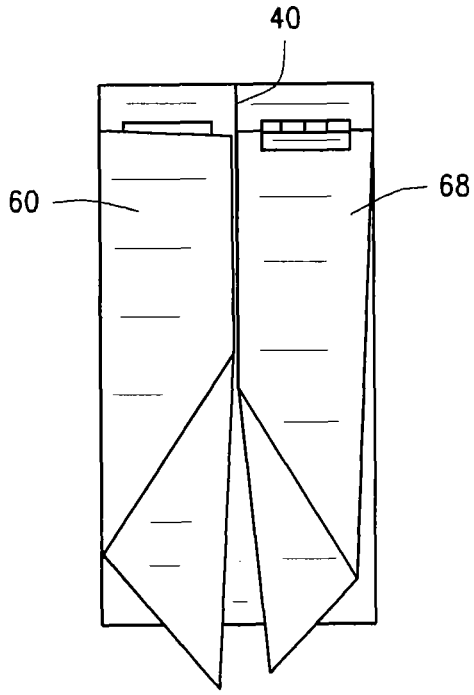
FIG. 20 is a right side view of the turner module of FIG. 17 with the right side wall removed so as to better illustrate the shape and function of the various components of the module.
Figure 21:
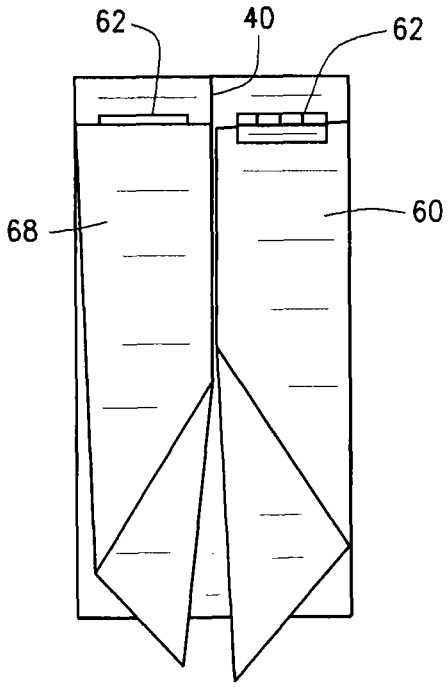
FIG. 21 is a left side view of the turner module of FIG. 17 with the left side wall removed so as to better illustrate the shape and function of the various components of the module.

Each outer wall 54 further includes another pin aperture 58 (FIG. 14). The pin aperture 58 is configured to accept the pin 52. The pin aperture 58 is located above the access opening 56. The left most module 36 of FIG. 14 illustrates the pin 52 removed to show pin aperture 58.

Returning to FIGS. 2-11, the inner channel 44 of each module 36 has a respective inclined turning plate 60 rotatably or pivotably secured to its respective side wall 38, at an angle comparable to the angle of the downwardly sloping edge 46 of vertical plate 40. A connector 62 rotatably or pivotably connects the plate 60 to the wall 38. Illustratively, the connector 62 can comprise a hinge that rotatably secures the plate 60 to the side wall 38. As shown in FIG. 11, the hinge 62 can comprise spaced-apart generally cylindrical sleeves. Each of the sleeves defines a channel for receiving a hinge pin. Any rotatable connection of the plates 60 to the side walls 38, however, is intended to be within the scope of the present disclosure. As illustrated, the pin 52 supports the plate 60 within the inner channel 44.

The lower end of inclined plate 60 has an oblique bend line 64 (FIG. 3) (i.e., a bend line that extends across the width of plate 60 at an angle) across the inclined plate 60 thus defining a lower chute plate or surface 66 which slopes downwardly and outwardly from the oblique bend line beneath the edge 46 of vertical plate 40. This configuration turns or diverts grain flowing down the inner grain channel 44 on the upper surface of plate 60 to the outer channel 42 and to effect an approximately 180° twist or rotation of the grain column so as to exchange grain in widthwise direction within inner column 44.

Still referring to FIGS. 2-6, the outer grain channel 42 has a respective inclined turning plate 68 secured to its respective side wall 39 at an angle comparable and corresponding to the downwardly sloping edge 47 of vertical plate 40. The connector 62, illustratively shown in the form of a hinge, rotatably/pivotally secures the plate 68 to the side wall 38, 39. Any rotatable connection of the plates 68 to the side walls 39, however, is intended to be within the scope of the present disclosure. As illustrated, the pin 52 supports the plate 68 within the outer channel 42.

Similarly to the inclined plate 60, the inclined plate 68 has an oblique bend line 70 (FIG. 3) extending substantially across the inclined plate 68 and defining a lower chute 72 (FIG. 5) which slopes downwardly and inwardly beneath the edge 47 of the vertical plate 40. This configuration turns or diverts grain flowing down outer grain column 42 on the upper surface of the inclined plate 68 from the outer column 42 into the inner column 44 and to effect an approximately 180° twist in the grain column so as to exchange grain in a widthwise direction within outer column 42.

It will be noted that the undersides of inclined plates 60, 68 can define or form voids or spaces therebelow within the inner and outer channels 42, 44 and that the lower chutes 66 and 72 of these inclined plates 60, 68 extend from the inner channel into the channel and vice a versa. In this manner, grain flowing down the upper surfaces of inclined turning plates 60 and 68 has a space in the opposite grain columns into which it may flow while the grain is turned or diverted by the oblique bend lines 64, 70 and their respective lower chutes 66 and 72.

Further, due to the oblique bend lines 64 and 70 of the inclined plates 60 and 68, the grain flowing downwardly on the upper surfaces of the inclined plates 60 and 68 is effectively twisted about a vertical axis passing generally through the apex 48 of the vertical plate 40. In addition to exchanging grain between the inner and outer regions of the grain path 20, this twisting action of the grain insures the widthwise exchange of grain within a turner module 36.

As noted, the pin 52 is removably slidably received in the vertical plate 40. As illustrated in FIG. 11, the pin 52 includes a distal end 74, a proximal end 76 and a body 78 disposed therebetween. The proximal end 76 includes a bend or curve to form a handle 80 or grasping portion. As illustratively shown, the curve defines an angle of about 90°. The distal end 74 is configured to be inserted through the opening 58 in outer wall 54 and through the opening 50 in the vertical plate 40 to extend through the outer channel 42 and into the inner channel 44. The handle 80 and proximal end 76 of the pin are positioned adjacent to the outer wall 54 on the opposite side of the outer wall 54 as compared to the outer channel 44 (i.e., positioned between the outer wall 54 and dryer wall 18 (FIG. 1)). In this position, the vertical plate 40 supports the pin distal end 74 and supports a portion of the pin body 78 within the inner channel 44. The outer wall 54 supports the body 78 of the pin within the outer channel 42 while supporting the pin proximal end 76 outside of the outer wall 54. As shown, the proximal end 76 is positioned above the access opening 56. When acted upon by the user, the pin 52 is configured to removably slide out of the apertures 50 and 58 of the vertical plate 40 and the outer wall 54, respectively.

Figure 10:
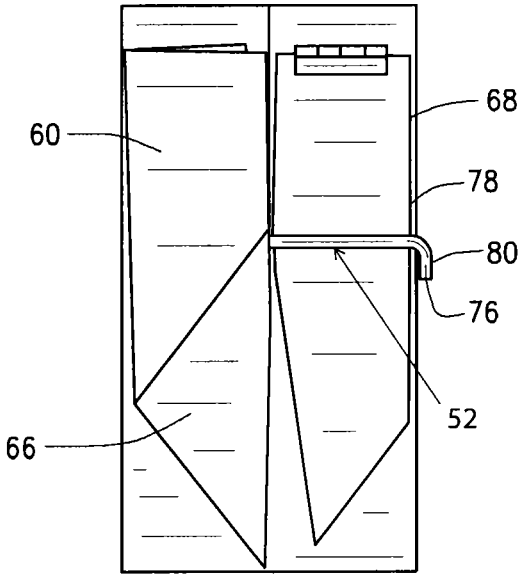
FIG. 10 is a right side view of the module of FIG. 7 with the right side wall removed so as to better illustrate the shape and function of the various components of the module.
Figure 11:
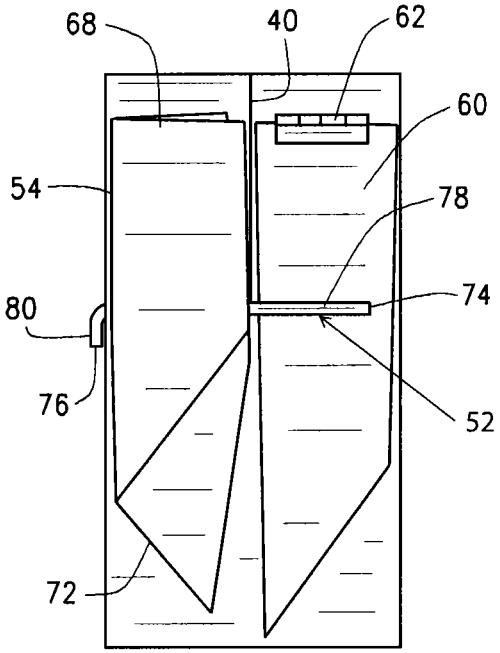
FIG. 11 is a left side view of the module of FIG. 7 with the left side wall removed so as to better illustrate the shape and function of the various components of the module.
Figure 12:
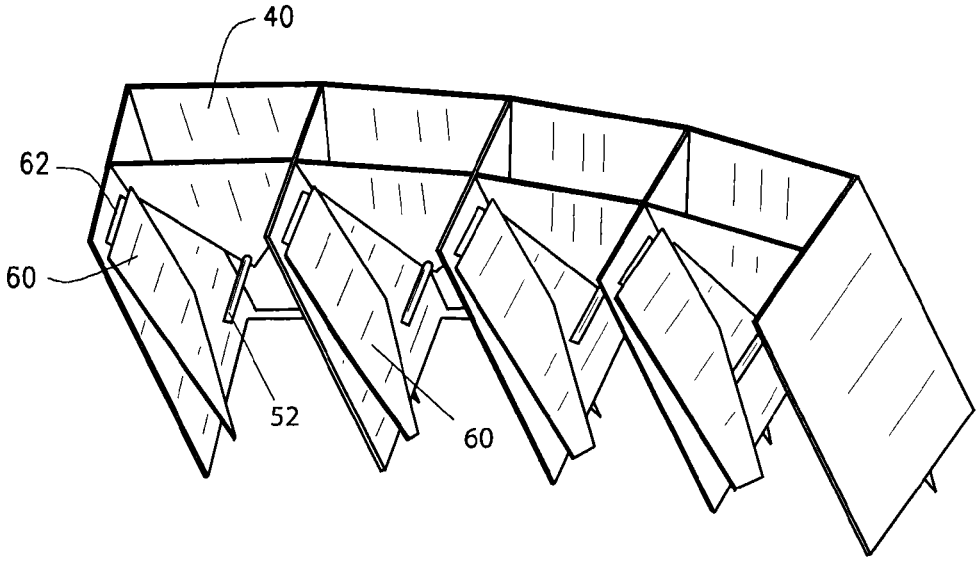
FIG. 12 is perspective view of the grain turner illustrating four turner modules arranged in a side-by-side relation and further illustrating the plates arranged in a collapsed or "down" position.

FIGS. 7-11 illustrate a single module 36 of the turner 34. FIGS. 10 and 11 illustrate right and left side views with the right and left sidewalls respectively removed for clarity. These views illustrate the pin 52 supporting the rotatable plate 60 within the inner channel 44 and the rotatable plate 68 within the outer channel 42.

Turning to FIGS. 12-16, the section of turner 34 illustrated is shown to have four modules 36 in the collapsed or "down" position. In particular, plates 60, 68 have rotated around the respective rotatable connector 62. In the downward position, the plates 60, 68 are positioned adjacent to respective sidewalls 38, 39 (FIG. 13). As illustrated, the drying path 20 is not blocked by the plates 60, 68; but instead the path 20 is free or substantially free from interferences. As will be discussed, the plates 60, 68 rotate downward under the force of gravity when the pin 52 is removed. In FIG. 14, the two left most modules illustrate the pin 52 removed while the remaining modules illustrate the pin reinserted. As shown in the right modules 36 of FIG. 14, the reinserted pins 52 are suspended within the outer channel 44 and the inner channel 42 by the walls 40 and 54.

As shown in the figures, the turner 34 includes a plurality of modules 36 that extend circumferentially around the tower 10. Each module 36 includes a turning unit comprising a pair of spaced vertical walls 38, 39, an intermediate circumferential wall 40 and an outer wall 54. The module 36 further comprises turning plates 60, 68 selectively deployed in either a turning position or a collapsed position and where the turning plates 60, 68 are supported in their turning or extended or up position by a pin 52 extending through the walls 40 and 54.

During one mode of operation for grain drying, the user inserts their hand through the access opening 56 to handle 80 the plates 60, 68 which are in the collapsed position. The user pivots the plates 60, 68 upwardly within the respective inner channel 42 and the outer channel 44. The plates 60, 68 are pivoted to a position above the pin aperture 40 of the vertical plate 40 and the pin aperture 58 of the outer wall 54. The user then inserts the proximal end 76 of the pin through the aperture of the outer wall 54. The pin 52 is further inserted across the outer channel 44, through the pin aperture 50 of the vertical plate 40 and into the inner channel 42.

The user continues to insert the distal end 74 of the pin into the inner channel until the handle 80 contacts the outer wall 54. The apertures 50, 58 of the vertical plate 40 and the outer wall 54 support the body 78 of the pin across the outer channel 44 and the inner channel 42. While still holding the plates 60, 68 with the user's hands, the user can rotate and lower the plates 60, 68 onto the pin 52 such that the pin 52 supports the plates 60, 68 in the extended or "up" position. Thus, the pin 52 is placed through the apertures 50, 58 such that the hinged plates 60, 68 rest on the pin 52 at their respective midpoints. Once the pin 52 supports the plates 60, 68, the user easily retracts his or her hand out of the opening 56. With the plates 60, 68 in their extended or "up" positions, the turner can receive and inter-mix falling or metered grain as previously discussed. In the extended position, the user can also conveniently use the access opening 56 to conduct any maintenance procedures as needed. If desired, retainers, such as cotter pins, can be used to prevent the pin 52 from coming out of the plate apertures 50, 58.

During another mode of operation for drying product such as soybeans or wheat wherein turning of the grain is not desired, the user grasps the handle 80 of the pin and pulls the pin 52 outwardly. The pin 52 removably slides out of the apertures 50, 58 of the vertical wall 40 and the outer wall 54. With the pin removed, the plates 60, 68 rotate downwardly under the force of gravity about the rotatable connection 62 to the collapsed position. Thus, the pin 52 keeps the plates 60, 68 in their extended position, but upon removing the pin 52, the plates 60, 68 swing down until they are substantially vertical and adjacent the sidewalls 38, 39. In this collapsed position, the drying path 20 is free or substantially free of any interference to allow the material to freely fall within the drying path 20 and the turner 34 does not turn or divert the product falling through the drying path to invert the column in the drying path. This collapsed position allows for easy by-pass for operations not requiring plates 60, 68 as well as easy clean up operations.

During this drying process, the user can store the pins 52 for further insertion at a later time. Or, the user can reinsert the pins 52 through the pin aperture 58 of the outer wall 54 so as to store the pins 52 in the tower dryer 10. To return the plates 60, 68 to their standard extended or "up" operation, the plates 60, 68 are moved up and back into position by hand and the pin reinserted so that the plates 60, 68 rest on the pin 52 at their midpoints.

The movement of the pins 52 and the resultant positions of the plates 60, 68 can be electronically or automatically controlled. Further, the turner 34 can be operated to allow a layer (not shown) of wet (i.e., less dried) grain to be left substantially undisturbed along the inner face of outer dryer wall 18. That is, this layer of grain can by-pass the turner 34. It has been found that by allowing this layer of "wet" or "moist" grain to remain proximate the outer dryer wall 18, that the amount of fines and other debris discharged to the atmosphere is substantially lessened as the grain is turned by grain turner 34. It has been further found that upon turning the grain in the grain turner 34, such that the drier grain from the inner reaches of the grain path 20 is exchanged with the more moist grain from the outer reaches of the grain path 20, the drier grain is disposed adjacent the layer along the outer dryer wall and that this facilitates satisfactory drying of the outer layer without having to turn the outer layer. As noted, this by-passing of the outer layer of grain is optional. For example, in larger dryers, such as tower dryers, it may be desirable to allow this outer layer to by-pass turner 34, but in a smaller, portable dryer, it may be desirable to turn the entire thickness of the grain path 20.

While the dryer, as described above, is a tower dryer (as shown in FIG. 1), it will be understood that the turner 34, as herein described, may be used with other types of grain dryers. For example, certain portable continuous flow dryers that also have spaced inner and outer porous walls with a vertical grain path 20 there between may utilize the grain turner 34 of this disclosure.

Figure 22:
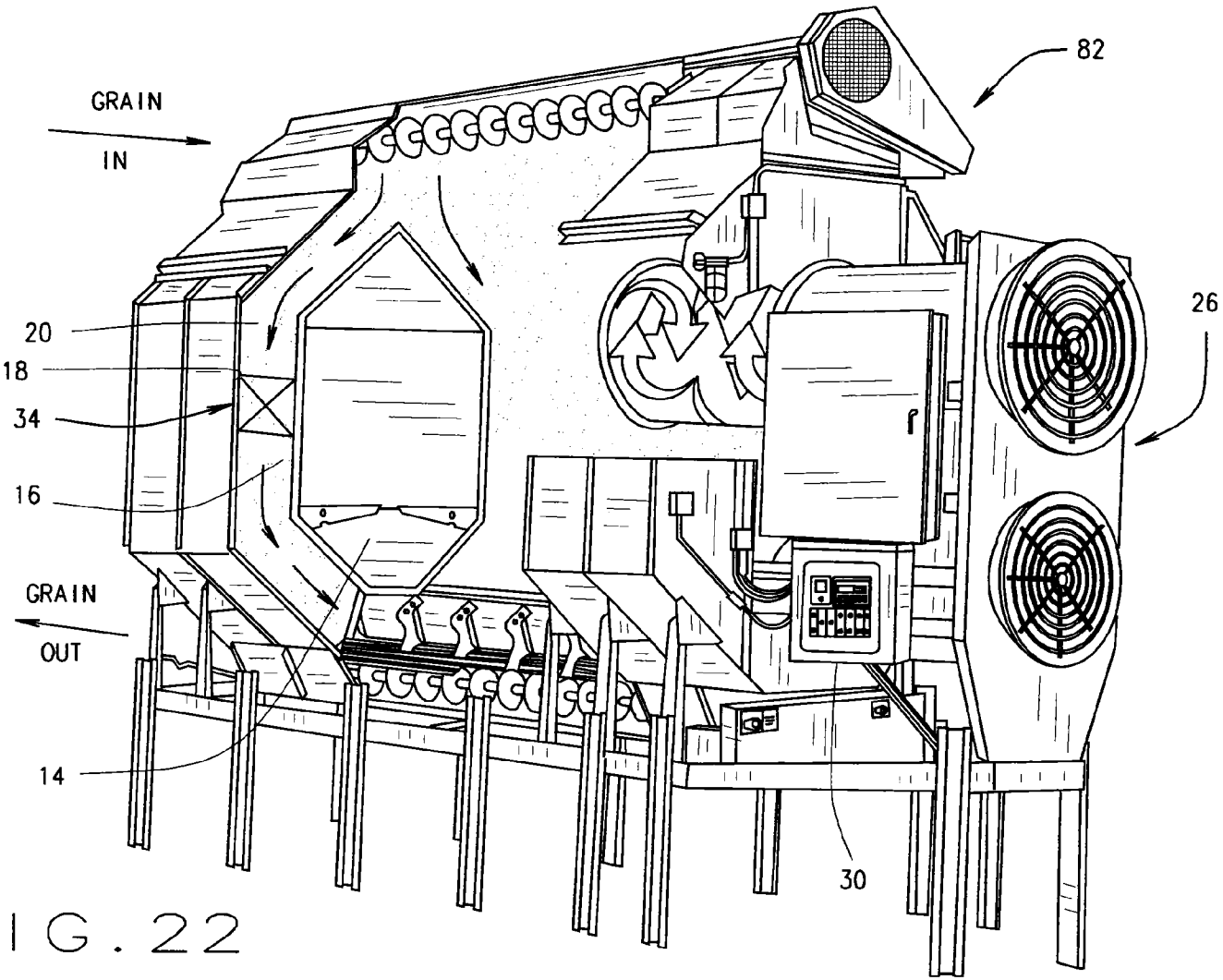
FIG. 22 is a perspective view of a so-called portable or modular grain dryer also having a turner of the present disclosure installed in its grain drying path.

Specifically, as shown in FIG. 22, a so-called portable grain dryer is indicated in its entirety at 82. The operation of such portable grain dryers is well known to those skilled in the art and for the sake of brevity, the construction and operation of such dryers is not fully herein described. However, in general terms, the portable dryer 82 has major components similar to tower dryer 10 and thus corresponding reference characters in FIG. 22 indicated corresponding components or features between the two dryers.

Dryer 82 is shown to have a turner 34 mounted within grain path 20 for turning the grain flowing downwardly within the grain path 20 in a manner similar to that described above in regard to tower dryer 10. In fact, the only substantial difference between the turner 34 used in portable dryer 82 and in tower dryer 10 is that, due to the shorter distance of the grain path 20 in the portable dryer 82, it is preferred that vertical walls 40 of the turner 34 be formed of porous sheet metal or the like so as to allow drying air to move through the grain as the grain flows through the grain turner 34. In other words, by providing such porous vertical walls 40 in the grain turner 34, the flow of drying air is not blocked by the grain turner 34.

It can be seen that the detailed description of the preferred forms and embodiments of the disclosure fulfill the objects and advantages set forth above. Inasmuch as numerous modifications may be made to the preferred embodiments without departing from the spirit and scope of the disclosure, the scope of the disclosure is to be determined by the scope of the following claims. For example, rather than using the pins 60 to support the inclined plates, the inclined plates could be moved between their raised and lowered positions by a pulley system. The cord, chain, etc. of the pulley system would then support the inclined plates in their raised position. This could potentially allow for altering the position of the plates from the ground. Alternatively, a linkage system could be used to move the inclined plates between their raised and lowered positions. Further, the movement of the plates 60 and 68 between their raised to their lowered positions could be automated so that the position of the inclined plates would not need to be changed manually. For example, a motor could be provided for the noted pulley system, or a piston could be provided for the noted linkage system. These examples are merely illustrative.

The invention claimed is:

1. A turner for a grain dryer, the grain dryer having an inner dryer wall and an outer dryer wall spaced from the inner dryer wall to define a vertically extending drying path between the inner dryer wall and the outer dryer wall, the turner comprising:

a pair of opposing generally vertical side walls;

a generally vertical dividing plate extending between the side walls and disposed between the inner and outer dryer walls, the dividing plate defining an inner channel and an outer vertical channel within the drying path of a grain dryer when the turner is installed in a grain dryer; and at least one pair of inner and outer inclined plates; the inner inclined plate being rotatably connected to one side wall on a first side of the divider plate and the second inclined plate being rotatably connected to the opposing side wall on an opposite side of the dividing plate; the inclined plates being selectively movable between a first, raised, position in which the first inclined plate is inclined downwardly in a first widthwise direction within the inner channel and with the second inclined plate being inclined downwardly in the opposite widthwise direction within the outer channel and a second, collapsed position in which the inner and outer plates are generally parallel to the side walls.

2. The turner of claim 1 wherein the inner and outer inclined plates are each curved, whereby when the inclined plates are in the raised position, the inner inclined plate directs grain from the inner channel to the outer channel and the outer inclined plate directs grain from the outer channel to the inner channel.

3. The turner of claim 1 wherein the divider plate is shorter than the side walls of the turner, such that the inner and outer channels are in communication below the divider plate.

4. The turner of claim 1 further comprising a pin which is slidably supported in the turner and is movable between a first position in which the pin extends into the inner and outer channels to support the inner and outer inclined plates in the extended position and a second position in which the pin does not support the inner and outer inclined plates, and the inclined plates rotate to the collapsed position.

5. The turner of claim 4 wherein the vertical plate includes a pin aperture, the pin being slidably received in the pin aperture.

6. The turner of claim 5 wherein the pin aperture in the inclined plate is a first pin aperture, the turner further comprising an outer wall; the outer wall having second pin aperture aligned with the first pin aperture.

7. The turner of claim 6 further comprising an access opening defined in the outer wall of the turner.

8. The turner of claim 7 wherein the access opening is positioned below the pin aperture of the outer dryer wall.

9. The turner of claim 1 further comprising a connector configured to rotatably connect the pair of plates to the side walls.

10. The turner of claim 9 wherein the connector is a hinge.

11. The turner of claim 1 wherein when the inclined plates are in their raised position, the inclined plates extend substantially across their respective channels.

12. The turner of claim 1 wherein when the inclined plates in the collapsed position, they are generally adjacent to the side wall to which the plates are rotatably connected.

13. The turner of claim 12 wherein the plates in the collapsed position provide a drying path free of interferences.

14. A turner for turning particulate matter in a column of falling particulate matter, the turner comprising at least one turner module, the at least one turner module comprising:

a first and a second opposing generally vertical side walls, the side walls having front and back edges;

a generally vertical dividing plate extending between the side walls and positioned between the front and back edges of the side walls; the dividing plate being shorter than the side walls; the dividing plate defining an inner channel and an outer vertical channel in a portion of the turner; and an inner inclined plate having an upper edge and a lower edge; the inner inclined plate being pivotally connected to the first side wall to be within the inner channel; the inner inclined plate being pivotal between a first position in which the inner inclined plate is inclined downwardly in a first widthwise direction and a second position in which the inner inclined plate is generally adjacent the first side wall; the inner inclined plate having a length such that when it is in the first position, the lower edge of the inner inclined plate being proximate a bottom of the divider plate;

an outer inclined plate having an upper edge and a lower edge; the outer inclined plate being pivotally connected to the second side wall to be within the outer channel; the outer inclined plate being pivotal between a first position in which the inner inclined plate is inclined downwardly in a second widthwise direction opposite the first widthwise direction and a second position in which the outer inclined plate is generally adjacent the second side wall; the outer inclined plate having a length such that when it is in the first position, the lower edge of the outer inclined plate being proximate a bottom of the divider plate;

the inner and outer inclined plates each defining a curve such that when the inclined plates are in the raised position, the inner inclined plate directs grain from the inner channel to the space below outer channel and the outer inclined plate directs grain from the outer channel to the space below the inner channel.

15. The turner of claim 14 wherein a top edge of the dividing plate is proximate a top edge of the side walls; the inner and outer channels of the turner being defined in an upper portion of the turner.

16. The turner of claim 14 comprising a support movable between a first position in which the inclined plates are in their raised position and a second position in which the inclined plates are in their lowered positions.

17. The turner of claim 16 wherein the support comprises a pin movable axially through the turner between a first extended position in which the pin extends into the outer and inner channels of the turner and a second position in which it is withdrawn from the channels of the turner.

18. The turner of claim 17 including an outer wall having a pin hole therein; the divider including a pin hole aligned with the pin hole in the outer wall, the pin holes being sized to slidably receive the pin.

19. The turner of claim 14 wherein the turner comprises at least two turner modules adjacent each other, wherein the first wall of a first of the at least two modules defines the second wall of the second of the at least two modules, such that the first and second modules of the at least two modules share a common wall.

* * * * *